US006813222B1

(12) United States Patent
De Salivet De Fouchecour

(10) Patent No.: US 6,813,222 B1
(45) Date of Patent: Nov. 2, 2004

(54) WATCH WITH RELATIVE READING

(76) Inventor: Marc De Salivet De Fouchecour, 12 rue de Quatrefages, 7-5005 Paris (FR)

( * ) Notice: Subject to any disclaimer, the term of this patent is extended or adjusted under 35 U.S.C. 154(b) by 0 days.

(21) Appl. No.: 09/830,959

(22) PCT Filed: Nov. 3, 1999

(86) PCT No.: PCT/FR99/02683

§ 371 (c)(1),
(2), (4) Date: Jul. 30, 2001

(87) PCT Pub. No.: WO00/26728

PCT Pub. Date: May 11, 2000

(30) Foreign Application Priority Data

Nov. 3, 1998 (FR) ..... 98 13824

(51) Int. Cl.[7] ..... G04B 19/20; G04B 19/04
(52) U.S. Cl. ..... 368/77; 368/228; 368/233
(58) Field of Search ..... 368/77, 80, 223, 368/221, 232, 233, 76

(56) References Cited

U.S. PATENT DOCUMENTS

| | | | | | |
|---|---|---|---|---|---|
| 3,102,380 | A | | 9/1963 | Dahl | |
| 3,803,831 | A | * | 4/1974 | Horzick | 368/233 |
| 3,890,777 | A | * | 6/1975 | Stanish | 368/77 |
| 4,034,554 | A | * | 7/1977 | Hadany | 368/221 |
| 4,653,930 | A | * | 3/1987 | Schmid | 368/232 |
| 4,759,002 | A | * | 7/1988 | Cash | 368/223 |
| 5,586,089 | A | * | 12/1996 | McGarvey | 368/223 |
| 5,943,300 | A | * | 8/1999 | Johnson | 368/77 |
| 6,463,012 | B1 | * | 10/2002 | Bar-Yona | 368/223 |

FOREIGN PATENT DOCUMENTS

| | | |
|---|---|---|
| CH | 188 264 | 12/1936 |
| CH | 662 234 | 9/1987 |
| DE | 40 03 655 | 4/1991 |
| DE | 43 30 895 | 3/1995 |
| EP | 0 209 335 | 1/1987 |
| FR | 368 617 | 12/1906 |
| FR | 2 265 124 | 10/1975 |

* cited by examiner

*Primary Examiner*—Tulsidas Patel
*Assistant Examiner*—Jeanne-Marguerite Goodwin
(74) *Attorney, Agent, or Firm*—Young & Thompson

(57) ABSTRACT

A watch comprising a motor driving in rotation a first rotary hour indicator at a period of 1/N revolution per day, and a second rotary minute indicator driven by a concentric axis. The invention is characterized in that the minute indicator (13, 23) is driven at a speed (N+1)/N revolutions per day, N being a whole number.

15 Claims, 3 Drawing Sheets

WATCH WITH RELATIVE READING

BACKGROUND OF THE INVENTION

The present invention relates to the field of clock making.

DESCRIPTION OF THE RELATED ART

A watch, regardless of its type (clock, pendulum clock, bracelet watch, alarm clock . . . ) usually includes a main dial including hour marks, generally 12 hour marks, as well as marks corresponding to minutes, generally 12 marks each spaced out by 5 minutes.

Two concentric needles, generally the foreground needle for minutes and the background needle for hours, run along this dial so that the hour and the minutes may be read by estimating the position of each of these needles with respect to the marks of a fixed dial.

European Patent EP209335 describing a clock mechanism driving the hour needle into a motion of 30° per hour and the minutes needle into a rotation of 360° per hour, is known.

In the state of the art, French Patent FR368617 describing a clock dial wherein the hour needle is fixed to a central disc which bears divisions indicating the minutes and which revolves with it, is also known. At each whole hour, both needles are then in the same direction and mark the same hour on a crown encircling the central disc.

In these documents of the nearest prior art, the indicators consist of fine and linear needles, the hour needle bearing the dial for reading the minutes.

Such watches of the prior art involve a risk of confusion as their reading seems identical to that of a watch with traditional needles, whereas the indication is radically different.

SUMMARY OF THE INVENTION

The object of the present invention is to provide a new clock mechanism, producing new visual effects and providing a new method for reading the time, without any risk of confusion with traditional watches. The object of the invention is to retain the surprising aspect of watches complying with the state of the art as discussed by Patent FR368617, while however finding a remedy to the technical disadvantages resulting from the visual closeness of the needle-shaped indicators to the usual needles of a watch.

For the, purpose the invention is directed to a watch including two indicators, producing a pattern formed by both indicators which is either additive (if for example, they are of the same color), or subtractive (if the indicator which is in the foreground has the same color as the background), or combinatory if there are more than three colors.

For this purpose, the invention relates in its most general acceptance, to a watch including a motor driving a first rotary hour indicator into rotation at a velocity of 1/N revolutions per hour, and a second rotary minute indicator driven by a concentric axis, characterized in that the minute indicator is driven at a velocity of (N+1)/N revolutions per hour and in that the indicators each have a shape producing a global surface with a variable shape, by covering or juxtaposing the shapes of both needles.

Such a realization enables visual effects from variable juxtaposition, superposition and covering of a surface to be produced so that it may be read free from any ambiguity and very succinctly as the exact time may be perceived intuitively in a glance, without having to break down the reading process out into two steps, one for perceiving the hour, the other for perceiving the fractions of an hour.

According to a first alternative embodiment, N is equal to 12.

According to a second alternative embodiment, N is equal to 24.

According to a first embodiment, reading the indications is accomplished by estimating the angular difference between both indicators.

With an alternative embodiment the indications may be read through generated geometrical conformations according to the relative position of the indicators and allowed by the shape of these indicators.

Preferably, a rotary indicator drives a mark for reading indications of the second rotary indicator. These marks are positioned in order to facilitate reading. In a particular embodiment, the mark for reading the indications of the second rotary indicator is formed by a concentric dial with both indicators, secured to the first hour indicator.

Advantageously, said concentric dial has marks spaced out by 360/k degrees, wherein k is an integer.

According to an alternative, the marks allow the indications to be read by means of their pattern or color configurations.

According to another embodiment, the hour indicator is formed by a plane element secured to the driving axis in a substantially peripheral point, and extending along a main radio axis substantially up to the edge of the main dial of the watch, and in that the minute indicator is formed by a second plane element secured to the driving axis at a substantially peripheral point, extending along a main radial axis substantially up to the edge of the main dial of the watch and placed in the foreground.

Preferably, both plane elements consist of discs.

Advantageously, both discs have a radius substantially equal to half the radius of the main dial of the watch.

According to an alternative, the minute indicator disc revolves in the reverse direction with respect to the hour indicator disc. In this case, the time course of the visible quarters complies with the moon's phases.

According to an alternative, a third second rotary indicator is driven by the same motor. This indicator is driven at the velocity of 1+(N+1)/(60*N) revolutions per minute.

According to a first alternative, the minute and hour indicators are indicators having the same color in order to form an additive variable covering or juxtaposition surface.

According to a second alternative, the indicator which is in the foreground has the same color as the background of the dial in order to form a subtractive variable covering or juxtaposition surface.

According to a third alternative, the minute indicator and the background have three differentiated colors in order to form a combinatory covering or juxtaposition surface.

According to a particular embodiment, the watch has an annular peripheral ring bearing time markings, wherein said ring is rotatively mobile in order to provide angular displacement depending on the time zone.

In the same way as for the hour indicator/minute indicator pair, one skilled in the art may adapt the types of aforementioned marks to the minute indicator/second indicator pair.

BRIEF DESCRIPTION OF THE DRAWINGS

The invention will be further described in detail in what follows, with reference to the appended drawings wherein.

DESCRIPTION OF THE PREFERRED EMBODIMENTS

Figure 1:
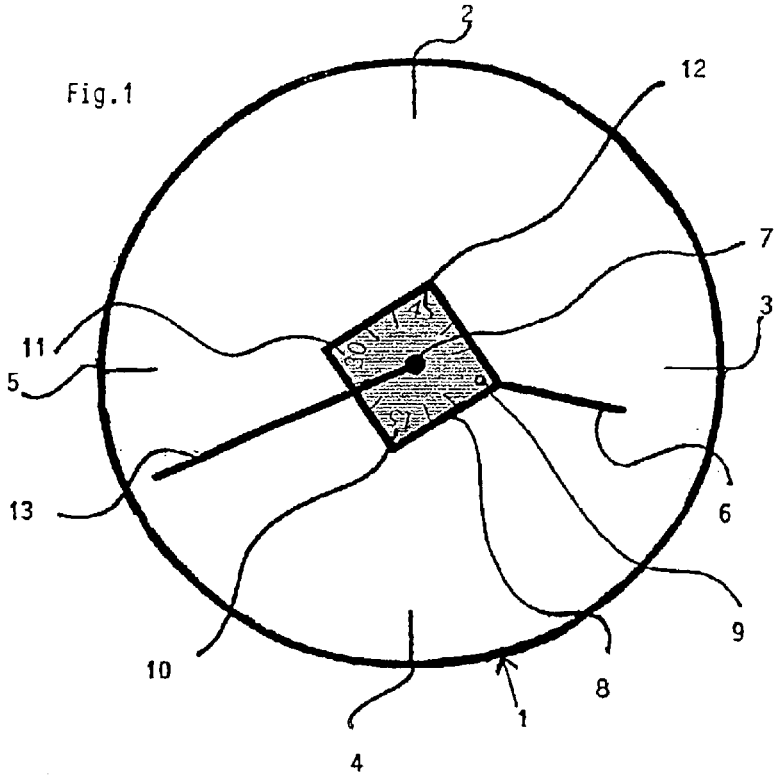
FIG. 1 shows a front view of a first exemplary embodiment of a watch according to the invention.

FIG. 1 shows a first exemplary embodiment of a watch according to the invention. It includes a fixed dial (1), disc-shaped in the described example, bearing hour marks (2, 3, 4, 5). A needle (6) constitutes the hour indicator. It is driven by a central axis (7). This needle is secured to a rotary central element (8), accomplishing a rotation in 12 hours. The central disc (8) has marks (9–12) corresponding to the minutes.

A needle (13) driven by an axis concentric with the main driving axis (7) and the central element (8) accomplishes 13 rotations in 12 hours, with respect to the fixed system of reference consisting of the body of the watch and the fixed dial (1), i.e. about 1.08333 revolutions per hour.

Reading the hours is accomplished by estimating the position of the hour needle (6) with respect to the hour marks (2–5) provided on the fixed dial.

Reading of the minutes is accomplished by estimating the position of the minute needle (13) with respect to marks (9–12) provided on the mobile dial (8).

The watch according to this embodiment attracts attention by the fact that both needles (6) and (13) are aligned and superimposed at each full hour, are aligned and opposite at each half hour, and are at right angles at each quarter of an hour, whatever the time of the day.

Figure 3:
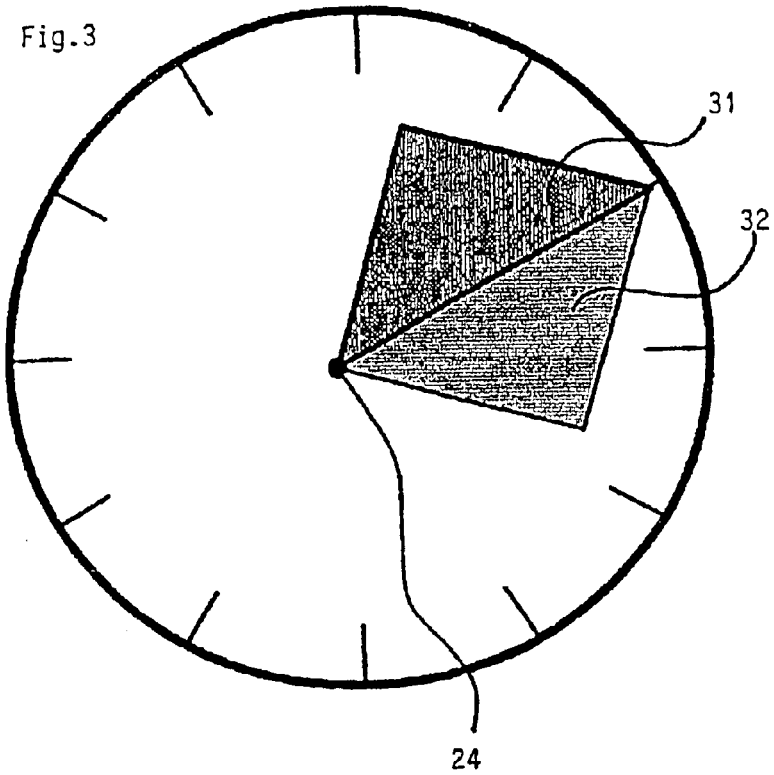
FIGS. 3 and 4 show a front view of a third exemplary embodiment of a watch according to the invention, at different times.
Figure 4:
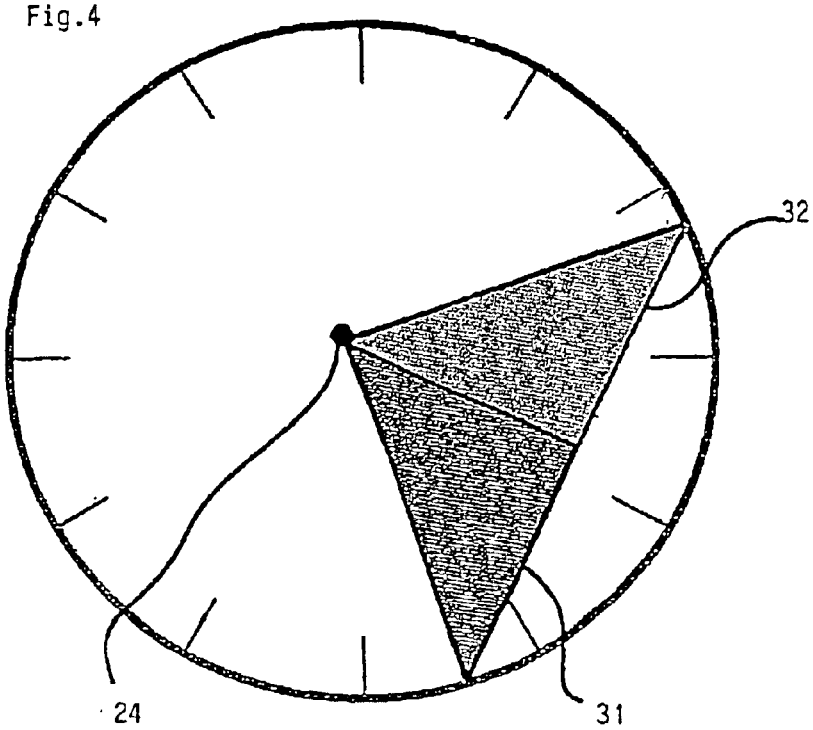

FIGS. 3 and 4 show an alternative of the first exemplary embodiment of the invention. The needles (31 and 32) have the shape of isosceles right-angled triangles. As the angle between these two indicators is the same according to the elapsed time with respect to the full hour, these elements always form a square at a full hour (FIG. 3) and a right-angled triangle at a quarter of an hour (FIG. 4). In this example, each of these conformations is repeatedly encountered with a period of exactly one hour.

Figure 2:
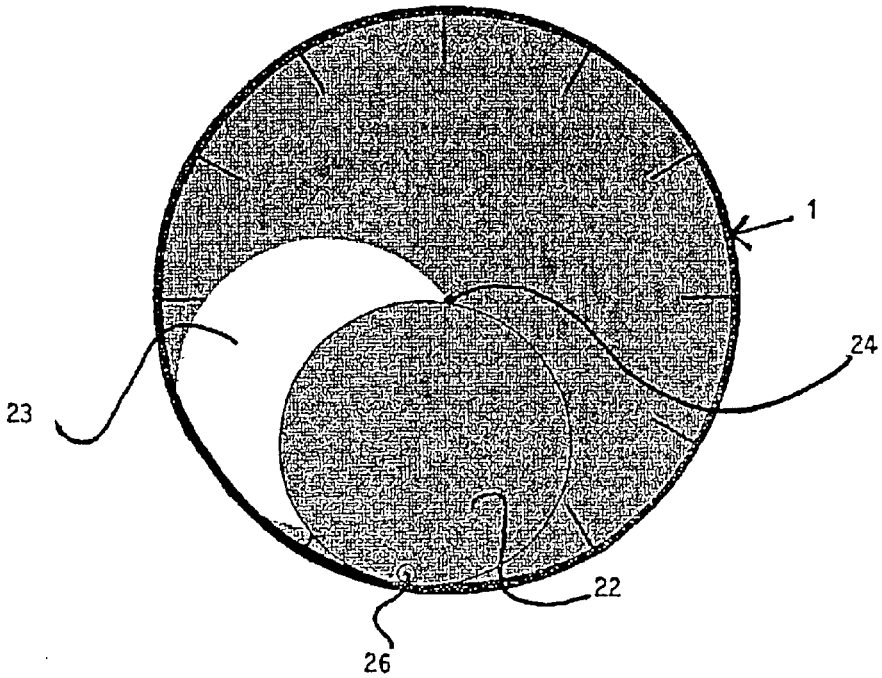
FIG. 2 shows a front view of a second exemplary embodiment of a watch according to the invention.

FIG. 2 shows a second exemplary embodiment of a watch according to the invention. It also includes a fixed dial (1) and two concentric central axes (24), one driving a discal element (22) for indicating the hours and the other a discal element (23) for indicating the minutes. The discs are fixed on the corresponding axis at a peripheral point. The diameter of the discs (22, 23) substantially corresponding to the radius of the main dial (1).

The discal element (22) accomplishes a rotation in 12 hours. Reading the hour is accomplished by estimating the position of the end of a radial axis with respect to the fixed dial (1). To facilitate reading, the discal element (22) may have a mark (26), for example a hole or a contrasted point.

The discal element (23) is in the foreground. It is driven into rotation at a velocity N+1 times greater than that of the discal element (22).

Reading the minutes is accomplished by estimating the covering or juxtaposition level of the hour discal element (22) by the minute discal element (23).

At the half-hour, both elements (22, 23) are in opposition and they do not cover each another. At the full hour, both discs (22, 23) entirely cover each another.

Between the full hour and the half-hour, the minute disc (23) progressively uncovers the hour disc (22), which will assume the shape of a waning moon quarter.

Between the half-hour and the next hour, the minute disc (23) gradually covers the hour disc (22), which will assume the shape of a waxing moon quarter.

The hour disc (22) may be white, and the minute disc (23) black, or any other combination of colors exhibiting a contrast.

The description which follows refers to the preferred embodiments.

In a first type of model, the indicator of the hours and that of the minutes have practically the same shape (half-disc, off-centered disc, inside of a spiral, rhombus, etc), have the same axis which does not pass through their center of gravity and are superimposed at each exact hour. The minute indicator may have the same color as the background of the watch, which enables the hour to be read by the surface portion of the hour indicator left visible by the minute indicator. A marking of the minutes may be borne by one or the other of the indicators or by both of them.

Another embodiment may be obtained by having the minute indicator bear a dial, whether circular or not, with minutes written in an opposite direction to the rotation direction of the indicators, so that the value of the minutes may directly be located on the hour indicator.

Figure 5:
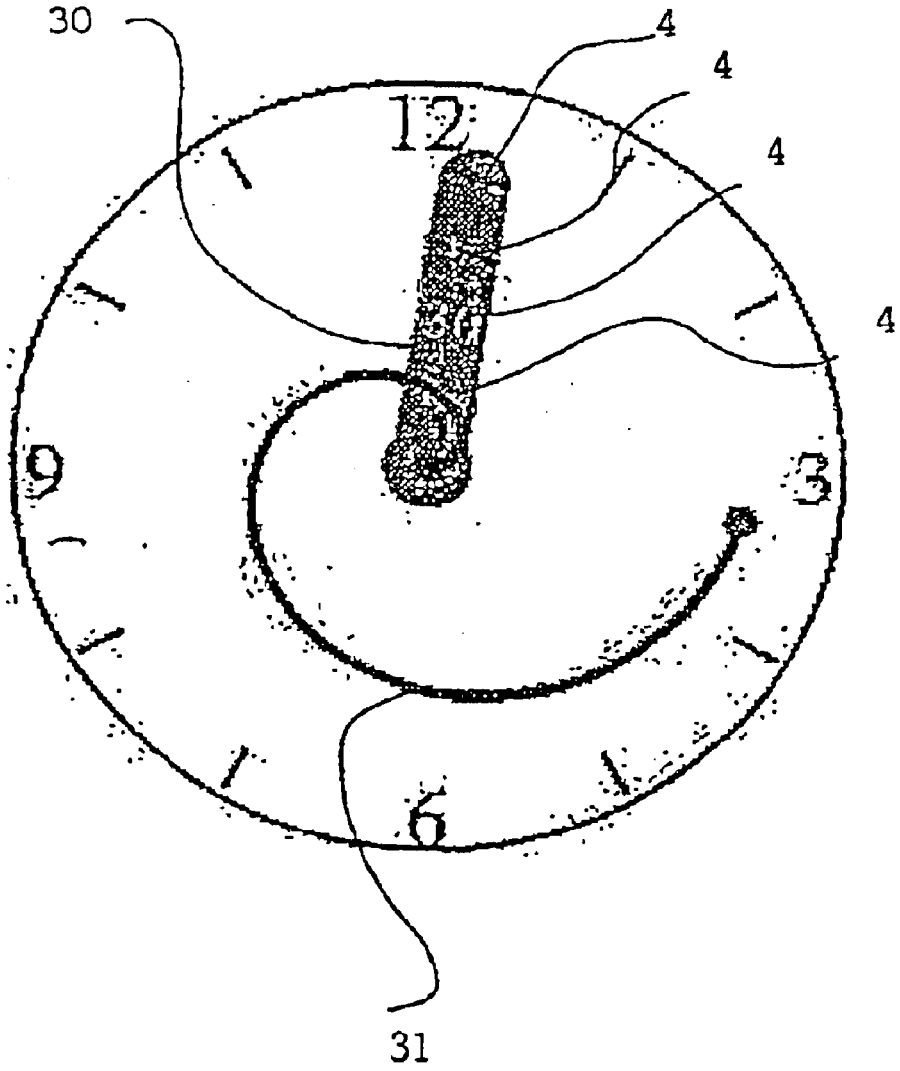
FIG. 5 shows a front view of another exemplary embodiment of a watch according to the invention with a spiral-shaped minute needle.

In another model illustrated in FIG. 5, the hour indicator is a rectilinear needle (30) of medium width, i.e. which is not reduced to a line, extending from the center to the periphery of the dial, and the minute indicator (31) has a spiral shape which makes a complete turn. The pitch may be constant or variable. The hour indicator has transverse graduated marks (32–34), spaced out radially depending on the pattern of the spiral-shaped needle. In such a way, the minutes may be read by the position of their indicator, but also by means of the intersection between the spiral-shaped needle and the graduated hour needle.

An alternative or the preceding model may be obtained by exchanging the shapes of both indicators, another one by using a diametral rectilinear indicator and the other by having a spiral shape with a U-turn.

An alternative embodiment goes back to the various principles above with the minute indicator located below the one for the hours.

Each model may be provided with a system which enables the unit formed by the indicators, the background of the watch and the caliber to turn as a whole with respect to the cradle and to the bracelet so as to display times corresponding to other time zones. Actually, in all the time zones at a given instant, the elapsed minutes since the full hour are the same and correspond for a watch according to the invention to the same angular difference between the hour and minute indicators.

The invention may give rise to different alternatives, wherein the essential feature lies in the fact that at least one of the indicators is a 2-dimensional flat element.

What is claimed is:

1. A watch including a motor driving a first hour rotary indicator into rotation according to a period of 1/N revolutions per hour, and a second minute rotary indicator driven by a concentric axis, wherein, the minute indicator (13, 23) is driven at a velocity of (N+1)/N revolutions per hour, N is an integer, the indicators each have a shape producing a cover or juxtaposition surface with a variable pattern, the hour indicator is formed by a first plane element (22) secured to the driving axis at a substantially peripheral point, and extending according to a main radial axis substantially up to the edge of the main dial of the watch, the minute indicator is formed by a second plane element (23) secured to the driving axis at a substantially peripheral point, extending according to a radial main axis substantially up to the edge of the main dial of the watch and placed in the foreground, the first plane element and the second plane element are both discs each having a radius substantially equal to half a radius of the main dial of the watch.

2. The watch according to claim 1 characterized in that N is equal to 12.

3. The watch according to claim 2 characterized in that a first rotary indicator (6, 22) drives a mark for reading indications of the second rotary indicator.

4. The watch according to claim 3 characterized in that the mark for reading the indications of the minute rotary indicator (13) is formed by a dial (8) concentric with both indicators (6, 13), secured to the hour indicator (6).

5. The watch according to claim 4 characterized in that said concentric dial (8) has marks spaced out by 360/k degrees, wherein k is an integer.

6. The watch according to claim 1 characterized in that N is equal to 24.

7. The watch according to claim 1, characterized in that a first rotary indicator drives a mark for reading indications of the second rotary indicator.

8. The watch according to claim 1, characterized in that the second indicator revolves at the velocity of 1+(N+1)/(60*N) revolutions per minute.

9. The watch according to claim 1, characterized in that the minute and hour indicators are indicators having the same color in order to form a additive variable covering or juxtaposition surface.

10. The watch according to claim 1, characterized in that the minute indicator which is in the foreground, has the same color as the background of the dial in order to form a subtractive variable covering or juxtaposition surface.

11. The watch according to claim 1, characterized in that the minute indicator, the hour indicator and the background have three differentiated colors in order to form a combinatory covering or juxtaposition surface.

12. The watch according to claim 1, characterized in that it has an annular peripheral ring bearing hour marks, wherein said ring is rotatively mobile in order to provide angular displacement according to the time zone.

13. The watch according to claim 1, characterized in that one of the indicators is a diametral rectilinear indicator and the other indicator has a spiral shape with a U-turn.

14. The watch according to claim 1, characterized in that the minute indicator is located below that for the hours.

15. A watch including a motor driving a first hour rotary indicator into rotation according to a period of 1/N revolutions per hour, and a second minute rotary indicator driven by a concentric axis, wherein, the minute indicator (13, 23) is driven at a velocity of (N+1)/N revolutions per hour, N is an integer, the indicators each have a shape producing a cover or juxtaposition surface with a variable pattern, the hour indicator is formed by a first plane element (22) secured to the driving axis at a substantially peripheral point, and extending according to a main radial axis substantially up to the edge of the main dial of the watch, the minute indicator is formed by a second plane element (23) secured to the driving axis at a substantially peripheral point, extending according to a radial main axis substantially up to the edge of the main dial of the watch and placed in the foreground, the first plane element and the second plane element are both discs, and the minute indicator disc revolves in the opposite direction to that of the hour indicator disc.

* * * * *